US008985243B2

(12) United States Patent
Yang et al.

(10) Patent No.: US 8,985,243 B2
(45) **Date of Patent: *Mar. 24, 2015**

(54) COMPOSITE DRILL BIT

(71) Applicants: Ying Xin Yang, Chengdu (CN); Lian Chen, Chengdu (CN); Min Lin, Chengdu (CN); Zhu Pei, Chengdu (CN); Hai Tao Ren, Chengdu (CN)

(72) Inventors: Ying Xin Yang, Chengdu (CN); Lian Chen, Chengdu (CN); Min Lin, Chengdu (CN); Zhu Pei, Chengdu (CN); Hai Tao Ren, Chengdu (CN)

(73) Assignee: Southwest Petroleum University, Chengdu, Sichuan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/740,197

(22) Filed: Jan. 12, 2013

(65) Prior Publication Data

US 2013/0126247 A1 May 23, 2013

Related U.S. Application Data

(63) Continuation of application No. PCT/CN2011/077217, filed on Jul. 15, 2011.

(30) Foreign Application Priority Data

Jul. 16, 2010 (CN) ..... 2010 1 0229371

(51) Int. Cl.

| | |
|---|---|
| ***E21B 10/14*** | (2006.01) |
| ***E21B 10/16*** | (2006.01) |
| ***E21B 10/50*** | (2006.01) |
| ***E21B 10/20*** | (2006.01) |

(52) U.S. Cl.

CPC ..... *E21B 10/16* (2013.01); *E21B 10/14* (2013.01); *E21B 10/50* (2013.01); *E21B 10/20* (2013.01)

USPC ..... 175/336; 175/353; 175/374

(58) Field of Classification Search

USPC ..... 175/331, 336, 349, 350, 351, 352, 353, 175/373, 376, 378, 374

See application file for complete search history.

(56) References Cited

U.S. PATENT DOCUMENTS

| | | | | |
|---|---|---|---|---|
| 2,340,492 A * | 2/1944 | Scott | 175/353 |
| 2,463,932 A * | 3/1949 | Zublin | 175/353 |
| 4,343,371 A * | 8/1982 | Baker et al. | 175/430 |
| 4,657,093 A * | 4/1987 | Schumacher | 175/353 |
| 4,848,476 A | 7/1989 | Deane et al. | |
| 5,147,000 A * | 9/1992 | Kaalstad | 175/334 |

(Continued)

FOREIGN PATENT DOCUMENTS

| | | |
|---|---|---|
| CN | 2725499 Y | 9/2005 |
| CN | 1727634 A | 2/2006 |

(Continued)

*Primary Examiner* — Robert E Fuller

(74) *Attorney, Agent, or Firm* — Novick, Kim & Lee, PLLC; Allen Xue

(57) ABSTRACT

A composite drill bit with a bit body configured at its upper extend for connection into a drillstring, comprising: a bit body (1) with at least one bit leg (3), at least one scraping-wheel (2) set with a cutter-row (4), and a set of cutters fixed thereon. The scraping-wheel (2) is mounted for rotation on the corresponding bit leg (3) with a large angular deflection $\alpha$ in the range of $20° \leq |\alpha| \leq 90°$. The cutters on the scraping-wheel break rock by means of successive scraping, forming a cross-cutting area on the bottomhole accompanied by the cutters on the fixed cutting unit, thus achieving high rock-breaking efficiency, even wear, high cooling performance, and a longer service life for the cutters, bearings and the drill bit.

19 Claims, 16 Drawing Sheets

(56) References Cited

U.S. PATENT DOCUMENTS

| | | | | |
|---|---|---|---|---|
| 5,562,171 | A * | 10/1996 | Besson et al. | 175/339 |
| 5,695,018 | A * | 12/1997 | Pessier et al. | 175/331 |
| 6,345,673 | B1 * | 2/2002 | Siracki | 175/353 |
| 6,863,138 | B2 * | 3/2005 | Siracki | 175/353 |
| 7,195,085 | B2 * | 3/2007 | Pia | 175/263 |
| 7,407,012 | B2 * | 8/2008 | Keshavan et al. | 166/374 |
| 7,686,104 | B2 * | 3/2010 | Singh et al. | 175/341 |
| 8,047,307 | B2 * | 11/2011 | Pessier et al. | 175/336 |
| 8,141,664 | B2 * | 3/2012 | Zahradnik et al. | 175/336 |
| 2008/0264695 | A1 | 10/2008 | Zahradnik et al. | |
| 2010/0018777 | A1 | 1/2010 | Pessier et al. | |

FOREIGN PATENT DOCUMENTS

| | | | |
|---|---|---|---|
| CN | 101892810 | A | 11/2010 |
| CN | 201751525 | U | 2/2011 |
| GB | 2433277 | A | 6/2007 |

* cited by examiner

COMPOSITE DRILL BIT

TECHNICAL FIELD

The present disclosure is related to drilling equipment technologies in petroleum and natural gas, mining engineering, infrastructure construction, geological and hydrological projects. More particularly, it is related to a composite drill bit.

DESCRIPTION OF THE RELATED ART

Drill bit is a rock-breaking tool in drilling engineering used to break rock and to form wellbores. Currently, drill bits used in drilling engineering are mainly cone bits (typically tri-cone bits and single cone bits) and PDC (polycrystalline diamond compact) bits.

As for the tri-cone bits, they break rock mainly by means of crushing, the cone/bit rotational speed ratio (the rotating speed ratio between the cone and the bit body in the drilling process) of tri-cone bits is larger than 1, so that the cone rotates fast with the teeth on it getting a short time contacting the formation, thus teeth exert impact crushing to break the bottomhole rock. Apparently, the compressive strength of rock is much higher than the shear strength and tensile strength, so both energy efficiency and rock-breaking efficiency of the tri-cone bits are relatively low when tri-cone bits break rock by impact crushing. Especially when drilling in the deep formation, cuttings hold-down effect caused by high density drilling fluid in the bottomhole is very prominent, making it very difficult for the teeth to penetrate further into the formation to exert effective crushing. One of the main factors limiting the service life of tri-cone bits is the short service life of bearings on it. Since tri-cone bits break rock by means of impact crushing with a high rotating speed, the bearings suffer large impact and high load amplitude, thus resulting in a short service life for the bearings and accordingly a short life for the bits. Currently, the angular deflection of cone bits is mostly no greater than 5°, which brings about a large cone/bit rotational speed ratio when the drill bits are rotating to drill, which means the rotating speed of the cone is high, accordingly, the contacting time between the teeth and bottomhole rock, as well as the slippage distance of the teeth, is very short. As illustrated in FIG. 20, the dimensions of pits (11) that are generated by the teeth on tri-cone bits are short in both radial and circumferential directions.

And as for the single cone bits, the bearing size is relatively large and the rotating speed of the cone is low, thus its service life is longer than tri-cone bits. There is, however, one unavoidable weakness for single cone bits, that is, the teeth wear resistance is low, and once the teeth are worn, the rate of penetration (ROP) decreases dramatically.

Nowadays, PDC (polycrystalline diamond compact) drill bits, with high wear resistance, long service life and without moving parts, are more and more widely used in drilling engineering with ever larger ratios. Existing PDC bits are nearly all fixed-cutter drill bits with polycrystalline diamond compacts (i.e. PDC cutters, also referred to as "cutters") distributed and affixed on the bit body according to certain patterns as cutting elements for rock breaking. For the purpose of timely bringing cutting debris to the surface, and meanwhile cleaning the drill bits and cooling the cutters, hydraulic structures are needed for PDC bits. The hydraulic structure typically comprises internal flow channel, external flow channel and jet orifice. Jet orifices, also known as nozzles, can be fixed nozzles directly attached to the drill bit body or replaceable nozzles mounted on the drill bit. In order to achieve better hydraulic performance, cutters on a PDC bit are typically divided into several groups with cutters in the same group affixed on one blade body, thus forming a cutting unit called fixed-blade cutting unit or simply fixed-blade or wing-blade, the groove between two adjacent wing-blades functions as the external flow channel.

Under ideal working conditions (i.e., central axis of drill bit and that of wellbore align with each other), the cutting track of a certain cutter on a PDC bit is a concentric circle. There are mainly three disadvantages for such fixed-cutter PDC bits:

First, when the PDC cutters continuously cut rock, temperature of the cutters tends to increase to a very high level due to the heat generated by intense friction. When the temperature exceeds a certain level, the wear rate of PDC cutters will increase significantly, causing thermo-wear effect (i.e., when the working temperature of a PDC cutter exceeds a certain level, wear resistance of the cutter decreases significantly) to happen.

Second, the failure of individual cutters (dropping-off, breaking or excessive wearing, etc.) will significantly increase the cutting load of those cutters located adjacent to them, thus accelerating the wear of the cutters, and consequently causing premature failure of the drill bit.

Third, the wear rate of bit cutters located in different radial areas is uneven, typically, much higher in the outer area (especially in the outer ⅓ radial area) than in the central area.

SUMMARY OF THE INVENTION

The present disclosure provides a composite drill bit, which comprises at least one scraping-wheel cutting unit with large angular deflection and a set of cutters fixed on the bit body. On one hand, large angular deflection enables the cutters on the scraping-wheel to break rock by scraping it in succession, on the other hand, cutters that fixed on the bit body and that on the scraping-wheel cut the bottomhole rock crosswise, forming a mesh-like pattern on the bottomhole, thus increasing the service life as well as the rock-breaking efficiency of the drill bit.

One embodiment of the present invention is as the following:

A composite drill bit, which comprises a bit body with at least one bit leg, at least one scraping-wheel set with a row (or rows) of cutters, and a set of cutters (i.e., a group of cutters fixed on the bit body with certain rules, typically presented in the form of fixed cutting unit such as fixed-blade or the like) fixed thereon. The scraping-wheel is mounted for rotation on the corresponding bit leg with a large angular deflection $\alpha$ which is in the range of $20° \leq |\alpha| \leq 90°$.

In the structure disclosed above, the scraping-wheel angular deflection $\alpha = \arctan(s/c)$, wherein, s is the offset distance of the scraping-wheel, c is the reference distance of the scraping-wheel. As illustrated in FIGS. 3, 4 and 5, AB is the central axis of the bit body, CD is the central axis of the scraping-wheel; $A_1$ is the axial plane of the scraping-wheel which contains scraping-wheel axis CD and is parallel with drill bit axis AB, $A_2$ is a plane which contains drill bit axis AB and is perpendicular to plane $A_1$, and $A_3$ is a plane which contains drill bit axis AB and is parallel to plane $A_1$. The points on the scraping-wheel which represent the location of cutters are defined as the set points of corresponding cutters. The set point of a cylindrical PDC cutter is the central point of the diamond working surface of the cutter (i.e., the intersection point of the cylinder axis and the diamond working surface), while the set point of a non-cylindrical PDC cutter can be defined as a point with specific geometric characteristic on the cutter.

Generally, cutters are deployed on the scraping-wheel in a row or rows. The row of cutters being deployed in the inner radial area of the scraping-wheel is defined as the inner-cutters-row which is also referred to as inner-row, while that in the outer radial area of the scraping-wheel is defined as the outer-cutters-row which is also referred to as inner-row.

The plane $A_4$, which contains all set points of cutters in the outer-row, is the datum plane of the scraping-wheel. Point E, the intersection point of plane $A_4$ and the scraping-wheel axis CD, is the datum point of the scraping-wheel. Draw a perpendicular line through point E and toward drill bit axis AB, then F is the foot point. The reference distance of the scraping-wheel, c, is the distance between the datum point E and plane $A_2$ of the scraping-wheel; and the offset of the scraping-wheel, s, is the distance between drill bit axis AB and the axial plane $A_1$.

The angular deflection $\alpha$ of the scraping-wheel is defined as the angle between line EF and plane $A_3$, that is, angular deflection $$\alpha = \arctan\left(\frac{s}{c}\right).$$

The angle $\alpha$ can be positive or negative according to the direction of its deflection. It is further provided, that viewing in the opposite direction of bit drilling and letting point E of scraping-wheel under the plane $A_3$, if point E is at the left side of the plane $A_2$, then $\alpha$ will be positive (as shown in FIG. 5); if at the right side, then $\alpha$ will be negative (as shown in FIG. 6); if point E is on the plane $A_2$, then $\alpha$ equals either to 90° or −90°, both of the two values referring to the same geometrical status of the scraping-wheel.

The journal angle $\beta$ of the scraping-wheel is defined as the angle between scraping-wheel axis CD and the plane which is perpendicular to the drill bit axis AB.

When the drill bit is driven to rotate to drill in formation, in addition to the rotary motion, axial feed motion, and other motions along with the bit body, the scraping-wheel is further engaged in rotary motion relative to the bit body (i.e., revolves about its own axis or the axis of the corresponding journal). If the angular deflection of the scraping-wheel is zero, i.e., the scraping-wheel axis intersects drill bit axis, scraping-wheel will engage in pure rolling motion, or nearly in pure rolling motion, on bottomhole rock, and its average speed is equal to, or almost equal to, the pure rolling speed which is determined by the drill bit rotary speed and the radius of the track circle of the scraping-wheel. In this condition, the contacting point between the cutter of the scraping-wheel and the bottomhole rock is the instant rotating center of the scraping-wheel, around which the scraping-wheel rotates without relative slippage on the bottomhole. If the angular deflection of the scraping-wheel is not zero, then the axis of the scraping-wheel does not intersect with the axis of the drill bit, instead they stagger in the space, thus the pure rolling motion condition is no longer satisfied. In this condition, the scraping-wheel still rolls on the rock, yet the rolling speed no longer equals to but is lower than the pure rolling speed, accordingly, the cutters on the scraping-wheel engage in slippage motion relative to bottomhole rock while rolling on the bottomhole, thus enabling scraping or cutting of the cutters against the rock.

When the angular deflection is not zero, the slippage of a cutter on the scraping-wheel is a combination of radial slippage and circumferential slippage. During a whole cutting process of a cutter on the scraping-wheel, from entering cutting to exiting from the formation, the radial position on bottomhole of the cutter is continuously changing. The radial displacement between the entering point and the exiting point represents radial slippage distance of the cutter. The larger the angular deflection is, the longer the radial slippage distance will be. Similarly, the circumferential position of the cutter is also changing continuously during its cutting process. Under a certain bit rotating speed, the cutting time of a cutter is mainly determined by wheel/bit rotational speed ratio which relies heavily on the value of angular deflection $\alpha$. The larger $\alpha$ is, the smaller the wheel/bit rotational speed ratio will be, and thus the circumferential slippage will be larger. The scraping velocity of a cutter on bottomhole rock is a resultant vector of radial scraping velocity and circumferential scraping velocity. Based on the kinematic characteristic of the scraping-wheel, the scraping tracks of the cutters are a group of spiral-like curves. If the angular deflection is positive, the track curves stretch from the perimeter toward the center of the borehole. And if the angular deflection is negative, the track curves stretch from the center toward the perimeter.

The increase of s and the decrease of c both result in the increase of the scraping-wheel angular deflection $\alpha$, and accordingly increase the radial slippage and circumferential slippage of the cutters on the bottomhole, i.e., increasing the total slippage of the cutters. According to experiments conducted and relevant analysis, when $\alpha$ is in the range of $20° \leq |\alpha| \leq 90°$, the rock-breaking effect of scraping will perform evidently.

The present disclosure provides combined fixed cutting unit and scraping-wheel cutting unit to achieve rock breaking. Both cutters on the scraping-wheel and fixed cutting unit break bottomhole rock by scraping. Cutters on the fixed cutting unit scrape out concentric-circle tracks on bottomhole rock, while on the other hand, cutters on the scraping-wheel scrape out spiral-like tracks that stretch either from the perimeter toward center or from the center toward perimeter of bore hole. Two sets of cutting tracks intertwine, forming a mesh-like cutting area on the bottomhole, such a mesh-like area, or cross-cutting area, makes the bottomhole rock more easily breakable, and accordingly, effectively increases rock-breaking efficiency of the bits. Moreover, when the most wearing-prone edge area of the bit engages the easily breakable cross-cutting area on the bottomhole, the cutting force and power of the cutters involved are both lowered, and finally resulting in a lowered wear rate. Additionally, cutters on the scraping-wheel cutting unit can offer special reinforcement for the area prone to wear on the fixed cutting unit. More specifically, the cutters on the scraping-wheel scrape the bottomhole rock in slow succession, which shortens the actual cutting time of each cutter, accordingly, the wear rate of cutters on the scraping-wheel is significantly lowered. And as a result, the lowered wear rate of cutters on the scraping-wheel will lower the wear rate of cutters on the fixed cutting unit. Generally speaking, the composite drill bit in the present invention can achieve even wear of cutters and meanwhile significantly increase service life of the drill bit.

Since cutters on the scraping-wheel break rock by means of scraping, WOB (weight-on-bit) needed by the scraping-wheel is relatively lower and more stable than tri-cone bit, additionally, wheel/bit rotational speed ratio of the composite drill bit is lower than that of tri-cone bit, therefore, a longer service life of bearing system can be expected for the composite drill bit.

The current disclosure also generally provides following:

Maintaining the scraping-wheel angular deflection $\alpha$ in the range of $20° \leq |\alpha| \leq 90°$, and increasing it through increasing offset s and/or decreasing the reference distance c, thus lowering the wheel/bit rotational speed ratio, increasing the scraping time as well as the total slippage (through increasing radial and circumferential slippage) on bottomhole rock. Thus, propelled by the drill bit body, cutters on the scraping-wheel will slowly penetrate into bottomhole rock by turns and then successively exit from the bottomhole rock with multiple long spiral-like tracks been scraped out. The spiral-like tracks scraped by scraping-wheel cutting units and the concentric-circle tracks scraped by fixed cutting units complement each other, forming a mesh-like cutting area on the bottomhole, such a mesh-like area, or cross-cutting area, makes the bottomhole rock more easily breakable, and accordingly, effectively increases rock-breaking efficiency of the bit.

Compared with existing technologies, embodiments in the present disclosure enjoy the following advantages:

(1) Scraping-wheel and fixed cutting units are combined together, forming two sets of cutting tracks which intertwine with each other to form cross cutting area or mesh-like area on the bottomhole, such a cross-cutting area makes the bottomhole rock more easily breakable, and accordingly, effectively increases rock-breaking efficiency of the bits. Moreover, when the most prone-to-wear edge area of a cutter engages the easily breakable cross-cutting area on the bottomhole, the cutting force and power of the cutters involved are both lowered, and finally resulting in a lowered wear rate. Generally speaking, the composite drill bit in the present disclosure can effectively increase rock-breaking efficiency in the abrasive formation and meanwhile significantly increase the service life of drill bits.

(2) The cutters on the scraping-wheel work by turns, thus premature failure of the bit caused by a few failed cutters, which usually occurs on a fixed-cutter bit, can be avoided, thus prolonging the service life of drill bit.

(3) The cutters on the scraping-wheel work by turns, thus achieving even wear for the cutters, and accordingly making full use of each cutter.

(4) The cutters on the scraping-wheel work by turns, thus achieving high cooling performance, and accordingly avoiding thermo-wear largely.

(5) The composite drill bit may utilize PDC and other diamond compound elements as cutters, making the service life and cutting efficiency of the cutters both superior to single cone drill bit.

(6) The composite drill bit needs a relatively light WOB, bringing a light load and small load amplitude for the bearings; moreover, with a low wheel/bit rotational speed ratio of the drill bit, the bearing rotates slowly and therefore less heat is generated. Accordingly, service life of composite drill bit bearing is longer than equivalent tri-cone drill bit.

According to further embodiments of this disclosure, at least one inner-row is deployed on the scraping-wheel.

Inner-row refers to the cutters row deployed on the inner side of the scraping-wheel, the number of it can be 1 or a plurality.

The cutters in the outer-row of the scraping-wheel cutting unit and those on the fixed cutting unit are polycrystalline diamond compacts, thermal-stable PDC cutters, natural diamond cutters, diamond-impregnated cutters, carbide cutters, cubic boron nitride cutters, ceramic cutters, or cutters containing diamond or cubic boron nitride.

The cutters in the outer-row of the scraping-wheel cutting unit and those on the fixed cutting unit are polycrystalline diamond compacts.

The cutters in the outer-row of the scraping-wheel cutting unit and those on the fixed cutting unit are polycrystalline diamond compacts, thermal-stable PDC cutters, natural diamond cutters, diamond-impregnated cutters, carbide cutters, cubic boron nitride cutters, ceramic cutters, or cutters containing diamond or cubic boron nitride.

The cutters in the outer-row of the scraping-wheel cutting unit and those on the fixed cutting unit are polycrystalline diamond compacts.

The drill bit body comprises at least one scraping-wheel cutting unit comprising a scraping-wheel and a bit leg; and at least one fixed cutting unit is fixed with cutters thereon.

According to some other embodiments, two scraping-wheel cutting units and two fixed cutting unit are alternately deployed on the drill bit.

In some further embodiments, three scraping-wheel cutting units and three fixed cutting unit are alternately deployed on the drill bit.

The angular deflection $\alpha$ of the scraping-wheel is in the range of $30° \leq |\alpha| < 90°$.

The angular deflection $\alpha$ of the scraping-wheel is in the range of $40° \leq |\alpha| < 90°$.

The angular deflection $\alpha$ of the scraping-wheel is in the range of $45° \leq |\alpha| < 90°$.

When drilling, cutters on the scraping-wheel may engage in the effect called "tracking-cutting" which is defined as the following: when the bit rotates in the drilling process, the cutters fall into the cutting tracks (or scraping tracks) left during the previous rock-breaking process. When "tracking-cutting" happens, the cutters on the scraping-wheel penetrate into the existing cutting tracks on the bottomhole, increasing the difficulty for cutters to engage the rock, and meanwhile reducing the formation material they remove. Accordingly, "tracking-cutting" effect reduces the rock-breaking efficiency of the drill bit.

To avoid the "tracking-cutting" effect, the present disclosure provides embodiments of a drill bit with the following features:

There are at least two scraping-wheel cutting units; the angular deflection of at least one scraping-wheel is different from that of the other ones.

There are at least two scraping-wheel cutting units; the external diameter of at least one scraping-wheel is different from that of the other ones.

There are at least two scraping-wheel cutting units; the journal angle of at least one scraping-wheel is different from that of the other ones.

There are at least two scraping-wheel cutting units; the spacing between adjacent cutters (hereinafter refer to as cutter-spacing) of the same row on at least one scraping-wheel is different from that of the other ones.

The cutters on the same scraping-wheel, in which, the cutter-spacing is not uniform.

The cutters on the same scraping-wheel, in which, cutter-spacing of the outer-row is different from that of the inner one.

The advantages of the above embodiments include:

(7) The non-uniformity of scraping-wheel angular deflection, the non-uniformity of the external diameter of scraping-wheel, the non-uniformity of the journal angle of scraping-wheel, the non-uniformity of cutter-spacing on the same scraping-wheel, the non-uniformity of cutter-spacing between each row of cutters, or (and), the non-uniformity of cutter-spacing between the scraping-wheel and the other scraping-wheels can avoid or eliminate the effect of "tracking-cutting", making the cutters scrape along the "rock ridge" (the raised rock area between two breaking tracks) on the bottomhole rock, thus keeping the body of scraping-wheel from being abraded by the raised "rock ridge", and making it easier for the cutters to penetrate into the rock, accordingly, increasing the rock-breaking efficiency of the bit.

In the present invention, cutters on the scraping-wheel scrape the formation by turns, complemented by the cutters on the fixed cutting unit, forming cross-cutting area on the bottomhole rock, thus achieving high rock-breaking efficiency, even wear, high cooling performance, and longer service life for the cutters, bearings and the drill bit.

BRIEF DESCRIPTION OF THE DRAWINGS

Embodiments of the present disclosure are illustrated with in following figures.

EMBODIMENTS

Figure 1:
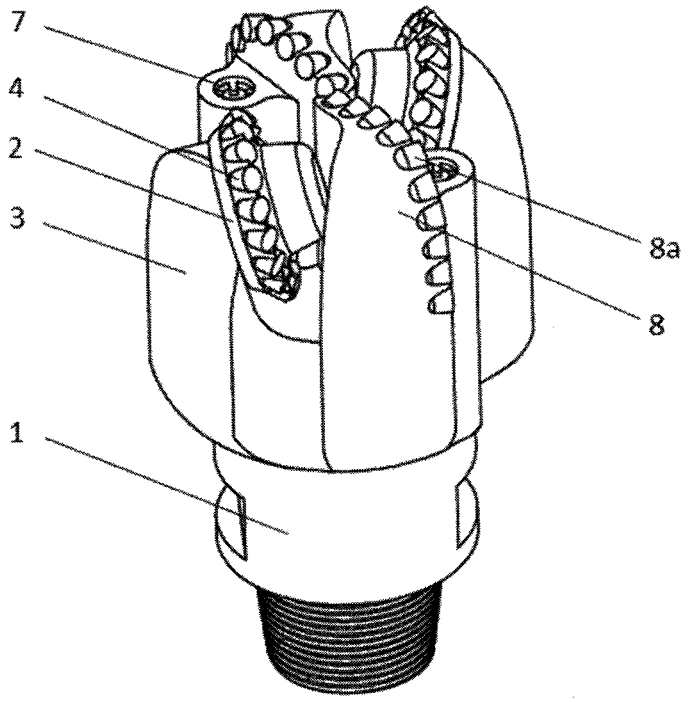
FIG. 1 illustrates the structure of an embodiment of the present invention, wherein, two scraping-wheel cutting units and two fixed cutting units are alternately deployed. In the figure: 1—drill bit body; 2—scraping-wheel; 3—bit leg; 4—outer-row; 7—nozzle; 8—fixed cutting unit; 8*a*—fixed cutters.
Figure 2:
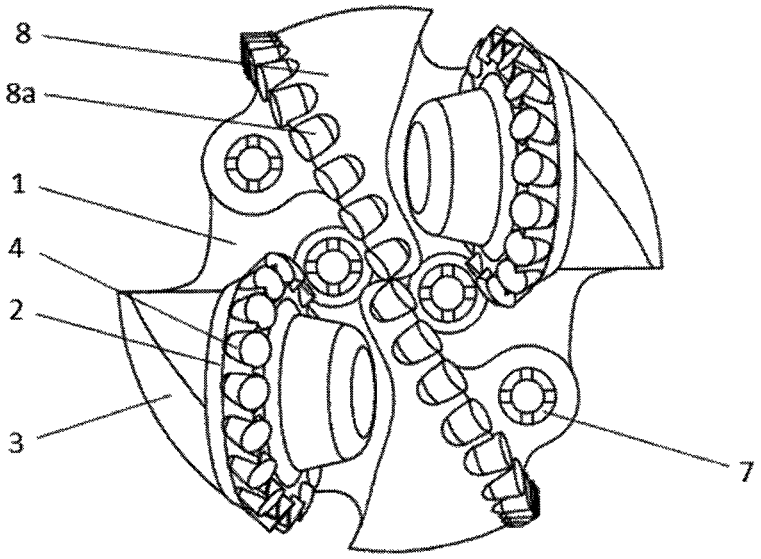
FIG. 2 is a top view along the axis (viewing opposite to the drilling direction) of the drill bit in an embodiment.
Figure 3:
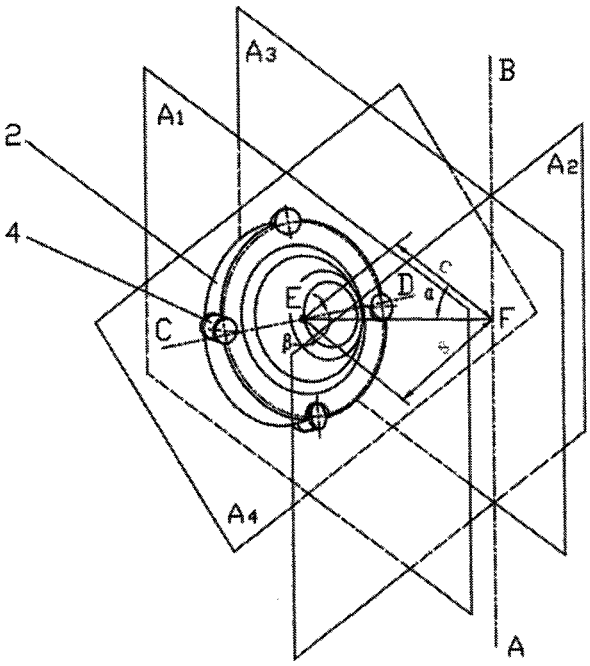
FIG. 3 is a schematic illustration of the geometric parameters in an embodiment, wherein, s is the offset distance, c is the reference distance, α is the angular deflection and β is the journal angle.

The present disclosure is further illustrated in details in reference to the following figures: It is to be noted, however, that the figures illustrate only some embodiments of the invention and therefore are not to be considered limiting of its scope as the invention may admit to other equally effective embodiments.

As illustrated in FIGS. 1, 2, 3, 4, 5, 6, 7, 8, 9 and 10: A composite drill bit, which comprises a bit body (1) with at least one bit leg (3), at least one scraping-wheel (2) set with a cutter-row (4), and a set of cutters (8*a*) fixed thereon. The scraping-wheel (2) is mounted for rotation on the corresponding bit leg (3) with a large angular deflection α which is in the range of $20° \leq |\alpha| \leq 90°$.

Embodiment 1

When the scraping-wheel (2) angular deflection α=±20°, take as example a drill bit with the external diameter (take the farthest point from the drill bit axis on the scraping-wheel as the gage point) D=8.5 inch (215.9 mm). Take the scraping-wheel (2) outer-row (4) radius r=65 mm, scraping-wheel journal angle 13=0°, since:

$$s = c \cdot \tan|\alpha| \tag{1}$$

$$\left(\frac{D}{2}\right)^2 = (r+s)^2 + c^2 \tag{2}$$

From equations (1) and (2), it can be obtained that the reference distance c=62.75 mm, scraping-wheel (2) offset distance s=22.84 mm.

Figure 11:
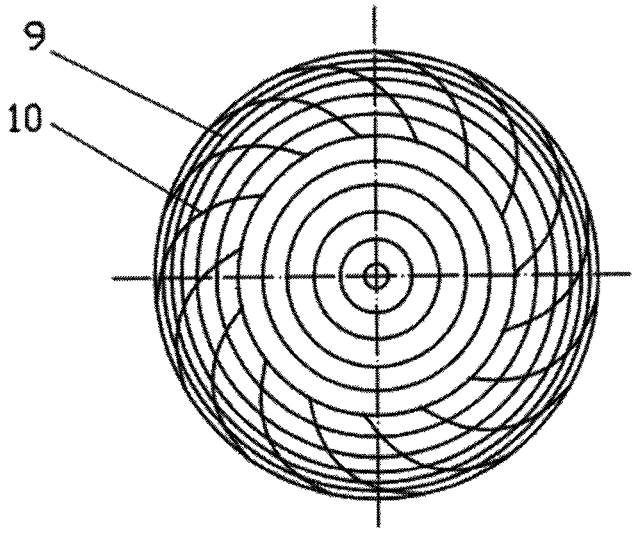
FIG. 11 is a schematic illustration of the mesh-like scraping pattern on the bottomhole created by an embodiment in the present invention, with the angular deflection α=20°. In the figure: the numeral 9 are the concentric scraping tracks created by the cutters on the fixed cutting units; the numeral 10 is the spiral-like tracks created by the cutters on the scraping-wheels.

With the above parameters, the radial slippage distance of the cutters on the outer-row (4), from entering to exiting from the bottomhole rock, will be 41.17 mm. According to both theoretical calculation and experiments conducted, the wheel/bit rotational speed ratio under such condition is below 0.96, i.e. the self-rotation speed of the scraping-wheel (2) is low when drilling, thus cutters on the scraping-wheel (2) penetrate into the formation with a slow speed, scraping a relatively long distance on the bottomhole rock, and then slowly exit from rock. FIG. 11, with the scraping-wheel angular deflection $\alpha=20°$, shows the mesh-like scraping pattern on the bottomhole rock created by an embodiment of the present invention with a combination of scraping-wheels cutting units and fixed cutting units. In the Figure: the numeral 10 is the spiral-like scraping patterns, from the perimeter toward center of borehole, created by the cutters on the scraping-wheel cutting units; the numeral 9 is the concentric scraping pattern created by the fixed cutters on the fixed cutting units. As illustrated in the figure, the long scraping tracks have evidently shown the successive scraping character of the cutters on scraping-wheel.

When the above D and r are kept constant, and maintaining $\alpha \geq 20°$, if the journal angle $\beta$ increases, then reference distance c decreases while offset distance s increases. As such, in spite of decreasing the cutters radial slippage on the bottomhole, the wheel/bit rotational speed ratio can be significantly reduced, thus increasing the circumferential slippage. And, the increase in cutters circumferential slippage is larger than the decrease in radial slippage, that is, when other parameters are constant, the increase in journal angle $\beta$ will further increase the total slippage on the bottomhole. Accordingly, with the above parameters, taking $\beta=0°$ will achieve the minimal slippage on the bottomhole.

In the following embodiments, always take $\beta=0°$.

Embodiment 2

When the scraping-wheel (2) angular deflection $\alpha=\pm30°$, still take a drill bit with external diameter D=215.9 mm as example. Take the scraping-wheel outer-row (4) radius r=65 mm.

According to equations (1) and (2), reference distance c=51.62 mm, scraping-wheel (2) offset s=29.81 mm.

Figure 12:
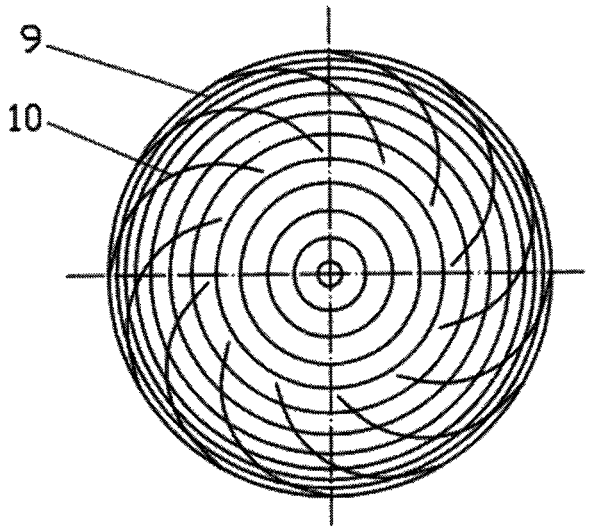
FIG. 12 is a schematic illustration of the mesh-like scraping pattern on the bottomhole created by an embodiment in the present invention, with the scraping-wheel angular deflection α=30°.

With the above parameters, the cutters radial slippage will be 48.34 mm. According to both theoretical calculation and experiments conducted, the wheel/bit rotational speed ratio under such condition is below 0.79, that is, it can be achieved for the cutters on the scraping-wheel (2) to successively scrape the bottomhole rock with a low speed. FIG. 12, with the angular deflection of the drill bit $\alpha=30°$, shows the mesh-like scraping pattern created by an embodiment of the present invention with a combination of scraping-wheel cutting units and fixed cutting units. As illustrated in the Figure, the slippage of the scraping-wheel is longer than when $\alpha=\pm20°$, showing the successive scraping character of the cutters on scraping-wheel.

Embodiment 3

When the scraping-wheel (2) angular deflection $\alpha=\pm40°$, D and r take the same values as above, according to equations (1) and (2), c=41.37 mm, s=34.71 mm.

Figure 13:
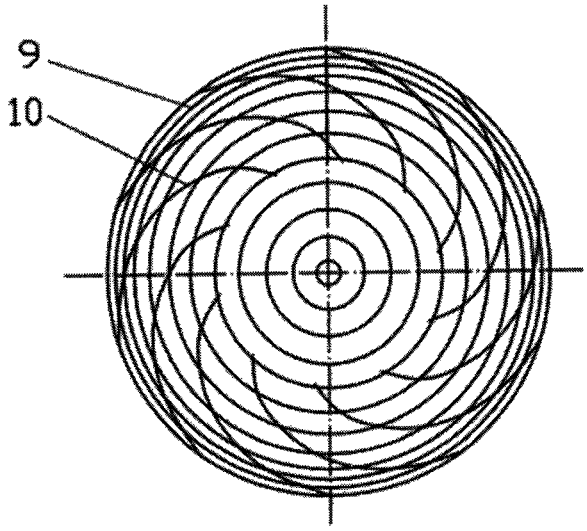
FIG. 13 is a schematic illustration of the mesh-like scraping pattern on the bottomhole created by an embodiment in the present invention, with the scraping-wheel angular deflection α=40°.

With the above parameters, the cutters radial slippage will be 53.95 mm, and wheel/bit rotational speed ratio is below 0.64. FIG. 13, with the angular deflection of the drill bit $\alpha=40°$, shows the mesh-like scraping pattern created by an embodiment of the present invention with a combination of scraping-wheel cutting units and fixed cutting units. Apparently in the Figure, the slippage of the cutters on the scraping-wheel is longer than when $\alpha=\pm30°$.

Embodiment 4

When the scraping-wheel (2) angular deflection $\alpha=\pm50°$, D and r take the same values as above, which yields c=31.97 mm, s=38.11 mm.

Figure 14:
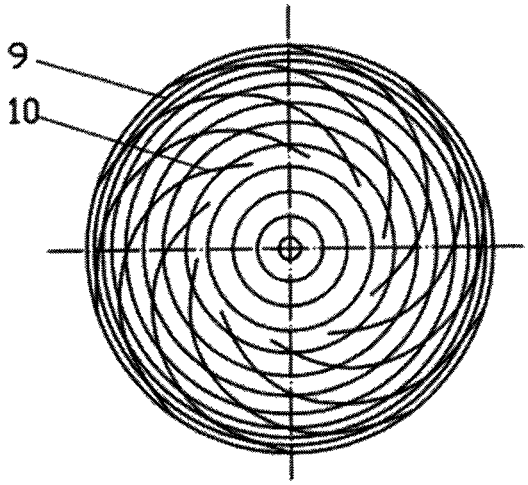
FIG. 14 is a schematic illustration of the mesh-like scraping pattern on the bottomhole created by an embodiment in the present invention, with the scraping-wheel angular deflection α=50°.

Now, the cutters radial slippage is 58.21 mm, the wheel/bit rotational speed ratio is below 0.49. FIG. 14, with the angular deflection of the drill bit $\alpha=50°$, shows the mesh-like scraping pattern created by an embodiment of the present invention with a combination of scraping-wheel cutting units and fixed cutting units. Apparently in the Figure, the slippage of the cutters on the scraping-wheel is longer than when $\alpha=\pm40°$.

Embodiment 5

When the scraping-wheel (2) angular deflection $\alpha=\pm60°$, D and r take the same values as above, which yields c=23.32 mm, s=40.40 mm.

Figure 15:
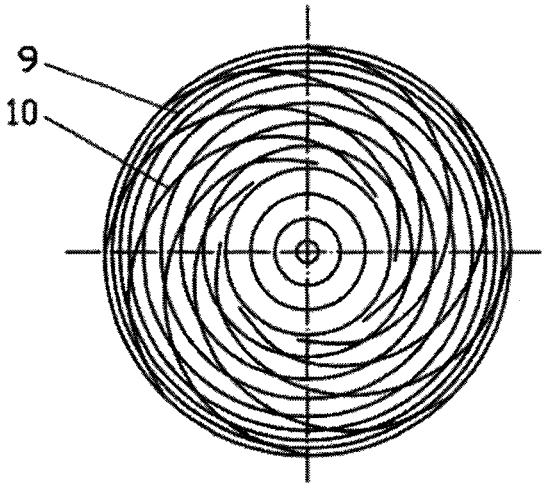
FIG. 15 is a schematic illustration of the mesh-like scraping pattern on the bottomhole created by an embodiment in the present invention, with the scraping-wheel angular deflection α=60°.
Figure 19:
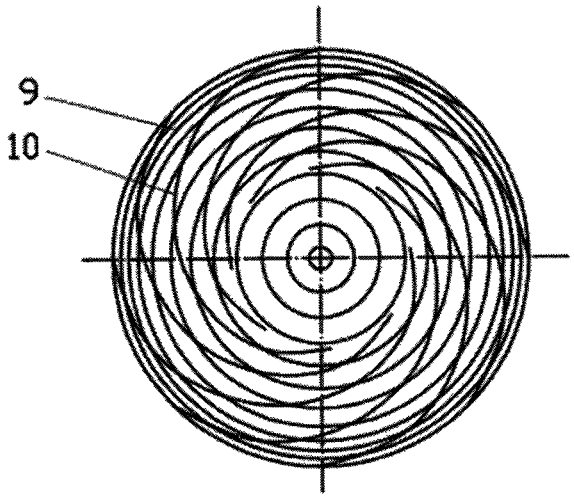
FIG. 19 is a schematic illustration of the mesh-like scraping pattern on the bottomhole created by an embodiment in the present invention, with the scraping-wheel angular deflection α=−60°.
Figure 20:
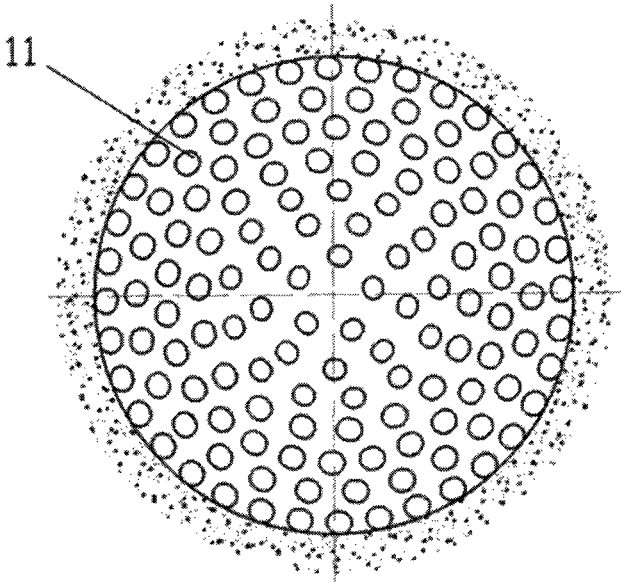
FIG. 20 is a schematic illustration of the cutter craters created by the ordinary tri-cone drill bit, wherein, the numeral 11 is cutter crater.

Now, the cutters radial slippage is 61.30 mm, the wheel/bit rotational speed ratio is below 0.36. FIG. 15 and FIG. 19, with the angular deflection $\alpha$ equals to 60° and $\alpha=-60°$ respectively, shows the mesh-like scraping patterns created by an embodiment of the present invention with a combination of scraping-wheel cutting units and fixed cutting units. Apparently in the Figures, the slippage of the cutters on the scraping-wheel is longer than when $\alpha=\pm50°$.

Embodiment 6

When the scraping-wheel (2) angular deflection $\alpha=\pm70°$, D and r take the same values as above, which yields c=15.24 mm, s=41.87 mm.

Figure 16:
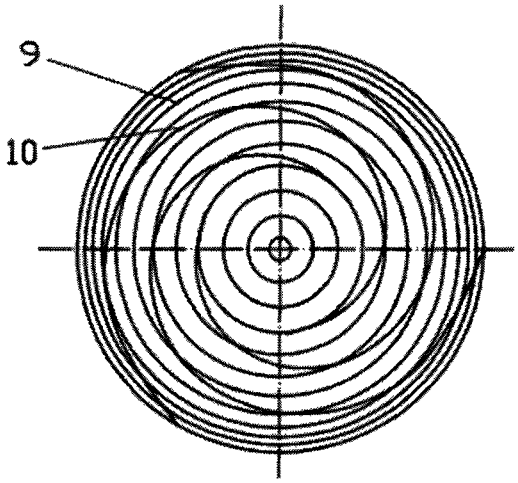
FIG. 16 is a schematic illustration of the mesh-like scraping pattern on the bottomhole created by an embodiment in the present invention, with the scraping-wheel angular deflection α=70°.

Now, the cutters radial slippage is 63.39 mm, the wheel/bit rotational speed ratio is below 0.23. FIG. 16, with the angular deflection of the drill bit $\alpha=70°$, shows the mesh-like scraping pattern created by an embodiment of the present invention with a combination of scraping-wheel cutting units and fixed cutting units. Apparently in the Figure, the slippage of the cutters on the scraping-wheel is longer than when $\alpha=\pm60°$.

Embodiment 7

When the scraping-wheel (2) angular deflection $\alpha=\pm80°$, D and r take the same values as above, which yields c=7.53 mm, s=42.69 mm.

Figure 17:
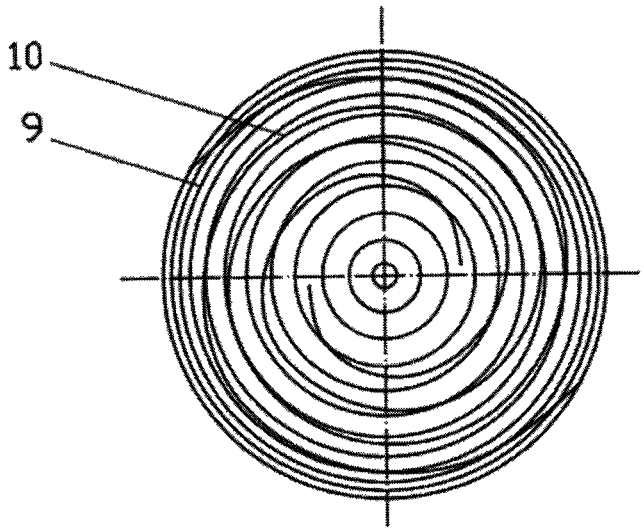
FIG. 17 is a schematic illustration of the mesh-like scraping pattern on the bottomhole created by an embodiment in the present invention, with the scraping-wheel angular deflection α=80°.

Now, the cutters radial slippage is 64.60 mm, the wheel/bit rotational speed ratio is below 0.12. FIG. 17, with the angular deflection of the drill bit $\alpha=80°$, shows the mesh-like scraping pattern created by an embodiment of the present invention with a combination of scraping-wheel cutting units and fixed cutting units. Apparently in the Figure, the slippage of the cutters on the scraping-wheel is longer than when $\alpha=\pm70°$.

Embodiment 8

Figure 18:
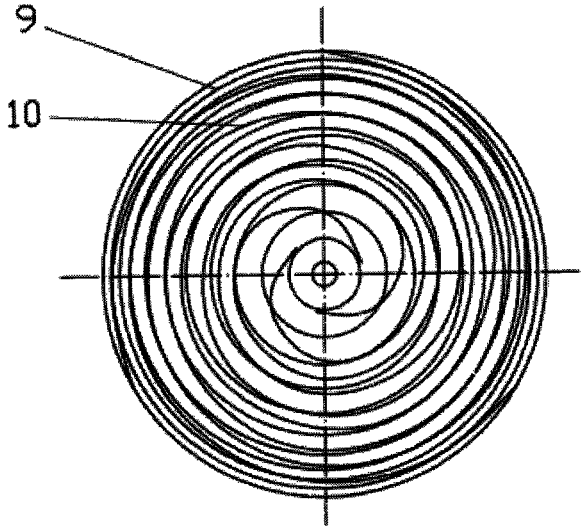
FIG. 18 is a schematic illustration of the mesh-like scraping pattern on the bottomhole created by an embodiment in the present invention, with the scraping-wheel angular deflection α=85° or nearly 90°.

When the scraping-wheel (2) angular deflection $|\alpha|$ equals to 85° or nearly 90°, in this embodiment, the reference distance c is small, while the offset s is comparatively far larger than c. Accordingly, the wheel/bit rotational speed ratio is even smaller and the self-rotating speed of the scraping-wheel is even lower, which will result in a longer slippage on the bottomhole, thus the scraping character of the cutters becomes even more evident. FIG. 18, with the angular deflection of the drill bit $\alpha$ equals to 85° or nearly 90°, shows the mesh-like scraping pattern created by an embodiment of the present invention with a combination of scraping-wheel cutting units and fixed cutting units.

With comparisons and analysis, it can be observed that, when the absolute value of the scraping-wheel (2) angular deflection $\alpha$ increases, wheel/bit rotational speed ratio decreases, while the cutters slippage increases. The larger the value of $|\alpha|$, the more obvious the cutters scraping effect. When the angular deflection $\alpha$ is in the range of $20° \leq |\alpha| \leq 90°$, cutters on the scraping-wheel (2) are enabled to slowly scrape rock in succession, scraping spiral-like tracks, and thus creating mesh-like pattern accompanied by the concentric-circle tracks scraped by fixed cutting units.

Figure 25:
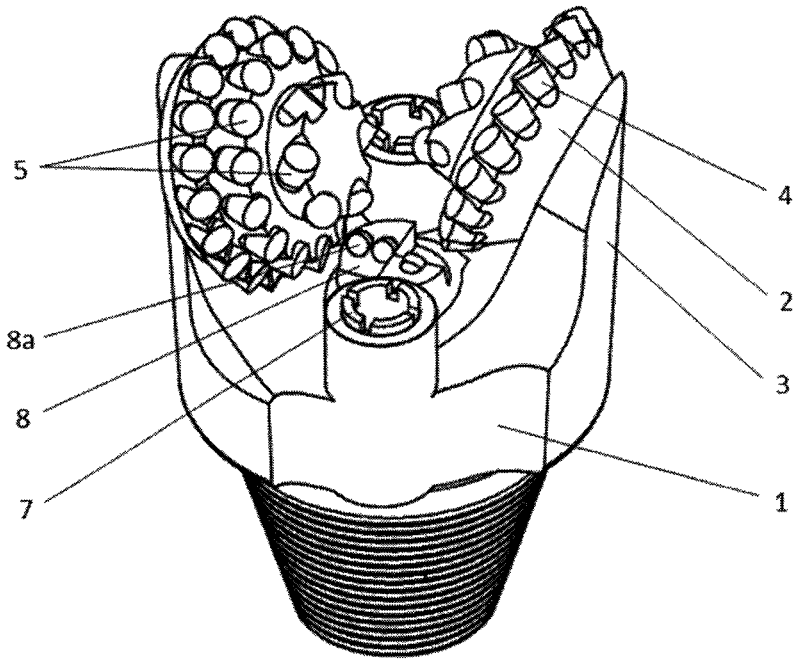
FIG. 25 is a schematic illustration of the scraping-wheels with two inner-rows.

There is at least one inner-row (5) on the scraping-wheel (2). FIG. 25 is a schematic illustration of the scraping-wheel with two inner-rows.

The outer-row (4), the inner-row (5) and fixed cutting unit (8), of which the cutters are polycrystalline diamond compact (PDC), thermally stable polycrystalline diamond cutters, natural diamond cutters, diamond-impregnated cutters, carbide cutters, cubic boron nitride cutters, ceramic cutters, or cutters containing diamond or cubic boron nitride.

The outer-row (4), inner-row (5) and fixed cutting unit (8), of which the cutters are PDC.

The drill bit body (1) comprises at least one scraping-wheel cutting unit comprising the scraping-wheel (2) and the bit leg (3); and at least one fixed cutting unit (8) with cutters (8*a*) fixed thereon.

The scraping-wheels cutting units (2) and the fixed cutting units (8) are of two for each and alternately deployed.

The scraping-wheels cutting units (2) and the fixed cutting units (8) are of three for each and alternately deployed.

The scraping-wheel angular deflection $\alpha$ is in the range of $30° \leq |\alpha| < 90°$.

The scraping-wheel angular deflection $\alpha$ is in the range of $40° \leq |\alpha| < 90°$.

The scraping-wheel angular deflection $\alpha$ is in the range of $45° \leq |\alpha| < 90°$.

Figure 21:
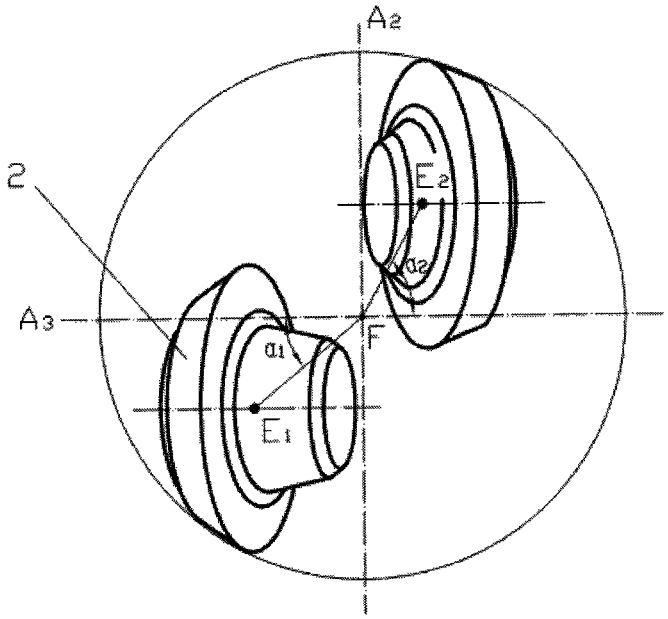
FIG. 21 is a schematic illustration of the scraping-wheels with different angular deflections; wherein, $\alpha_1 \neq \alpha_2$.

To avoid the effect of "tracking-cutting" of the cutters, the present invention implement the following solutions:

There are at least two scraping-wheel cutting units, the angular deflection of at least one of which is different from that of the other ones. As illustrated in FIG. 21, the angular deflections of two scraping-wheels are different, i.e. $\alpha_1 \neq \alpha_2$. For the condition with three scraping-wheels, the angular deflection of one of which is $\alpha_1$, while the other two are both $\alpha_2$, with $\alpha_1 \neq \alpha_2$; or further, one of the other two is $\alpha_2$, then the rest one is $\alpha_3$, with $\alpha_2 \# \alpha_3$.

Figure 26:
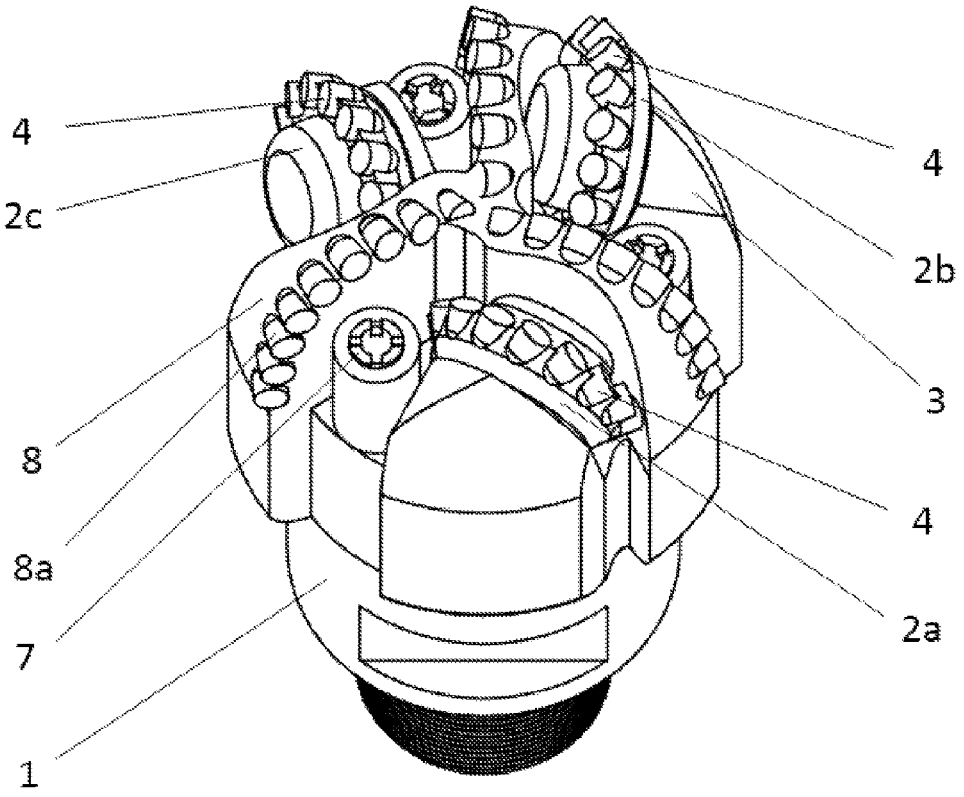
FIG. 26 is an isometric view of a drill bit of the current invention.
Figure 27:
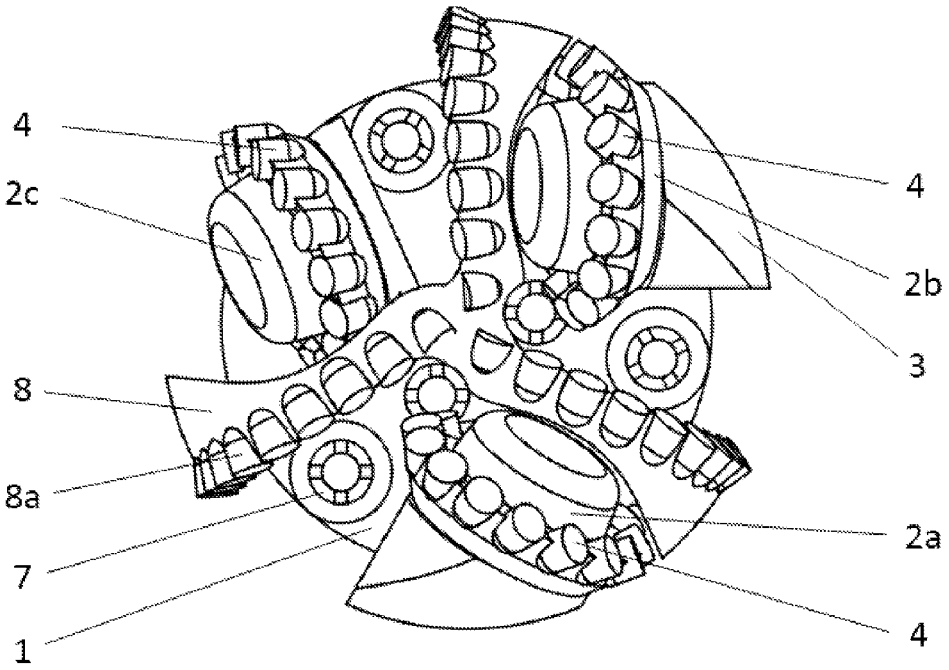
FIG. 27 is the top view of the drill bit in FIG. 26.

FIGS. 26 and 27 show an embodiment of current invention. The numerals in FIGS. 26 and 27 that are the same as in other drawings refer to the same parts unless otherwise indicated. As shown, two of the scraping wheels, 2*a* and 2*b*, have positive angular deflections, while scraping wheel 2*c* has a negative angular deflection.

Figure 4:
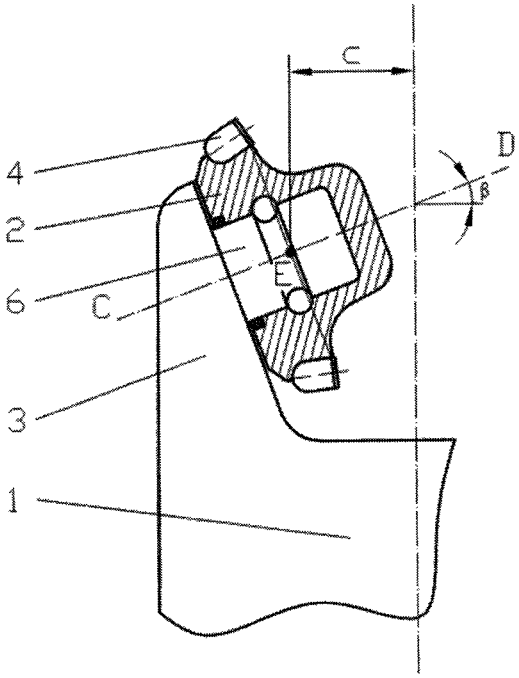
FIG. 4 is a cutaway view along the axial plane of the scraping-wheel in an embodiment, wherein, the numeral 6 is the journal on the bit leg.
Figure 5:
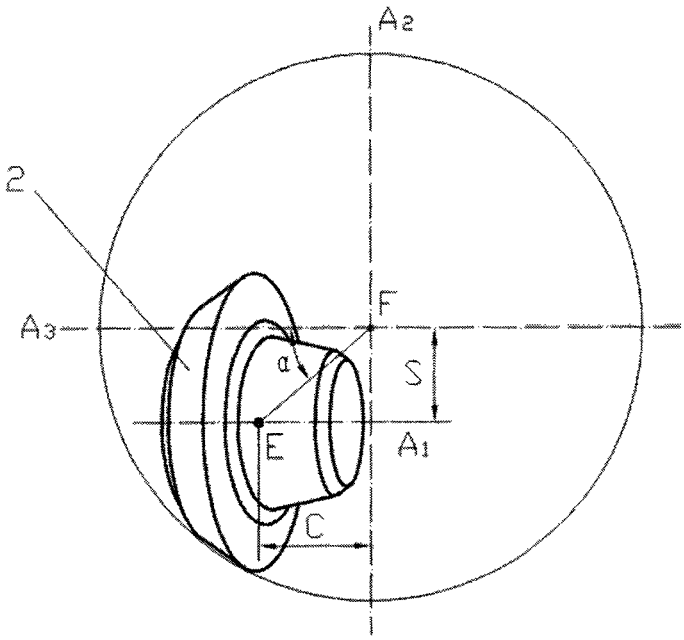
FIG. 5 is a schematic illustration of the geometric positional parameters s, c, α of the scraping-wheel relative to the drill bit in the top view along drill bit axis, wherein the angular deflection α is positive.
Figure 6:
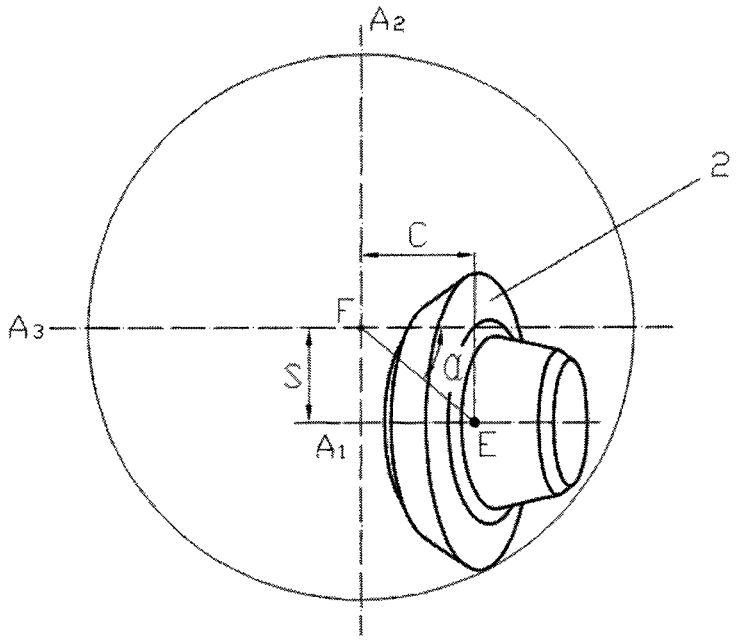
FIG. 6 is a schematic illustration of the geometric positional parameters s, c, α of the scraping-wheel relative to the drill bit in the top view along drill bit axis, wherein the angular deflection α is negative.
Figure 7:
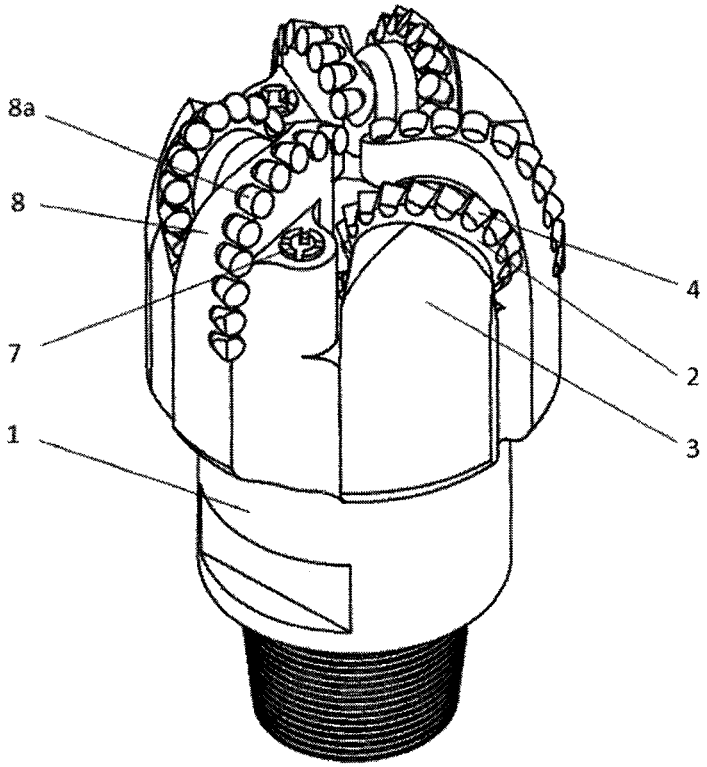
FIG. 7 is a schematic illustration of three scraping-wheel cutting units and three fixed cutting units in an embodiment, these cutting units are deployed alternately.
Figure 8:
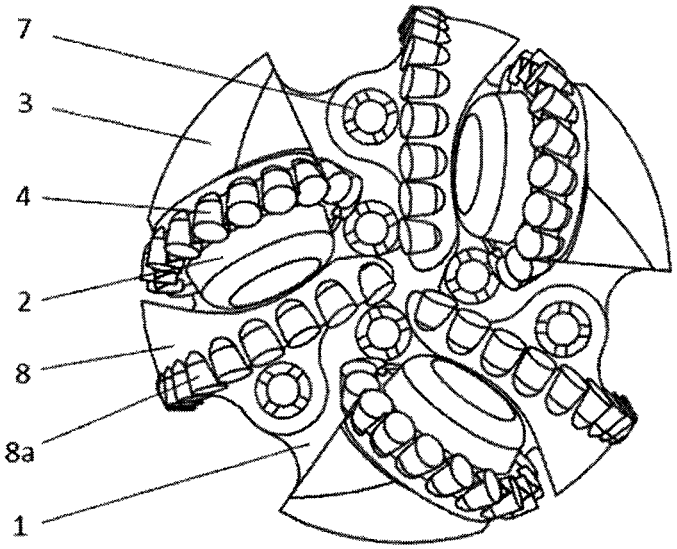
FIG. 8 is a top view of the structure in FIG. 7 along the drill bit axis.
Figure 9:
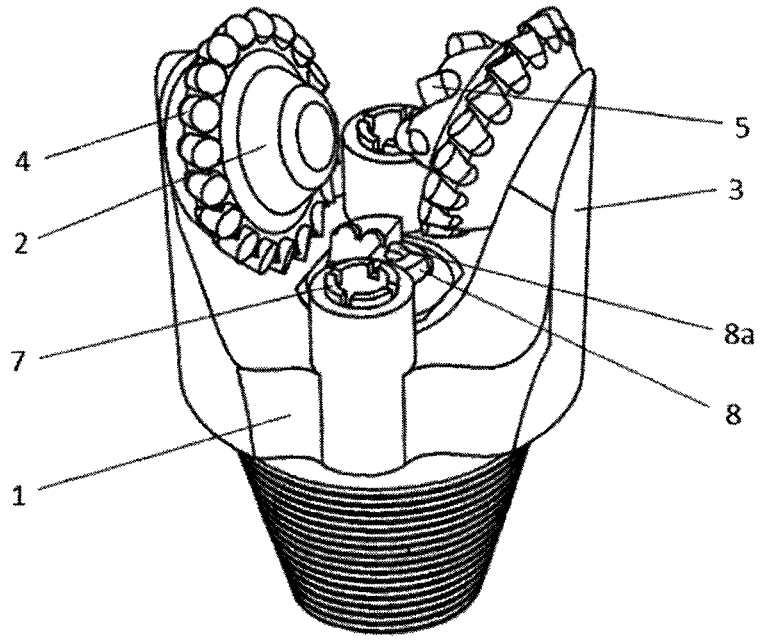
FIG. 9 is a schematic illustration of an embodiment in the present invention, comprising the fixed cutting unit in the center, and the scraping-wheel cutting unit on the periphery of the bit body. In the figure, the numeral 5 is the inner-row.
Figure 10:
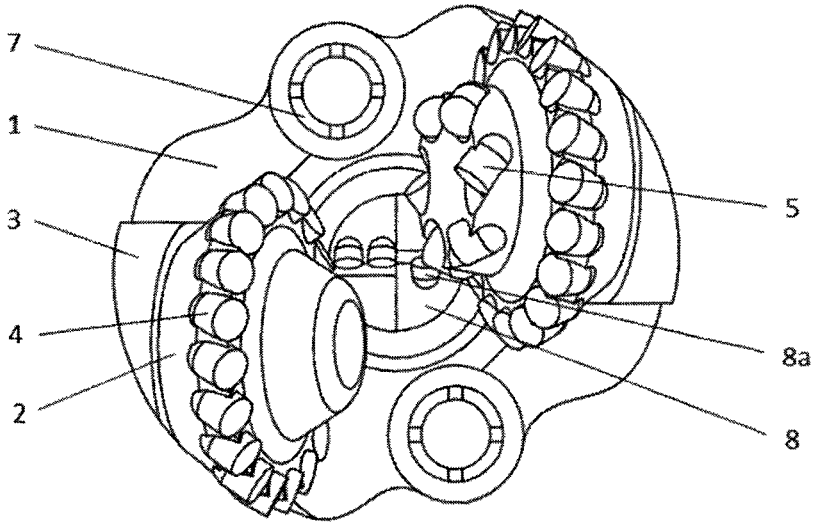
FIG. 10 is a top view of the structure in FIG. 9 along the drill bit axis.
Figure 28:
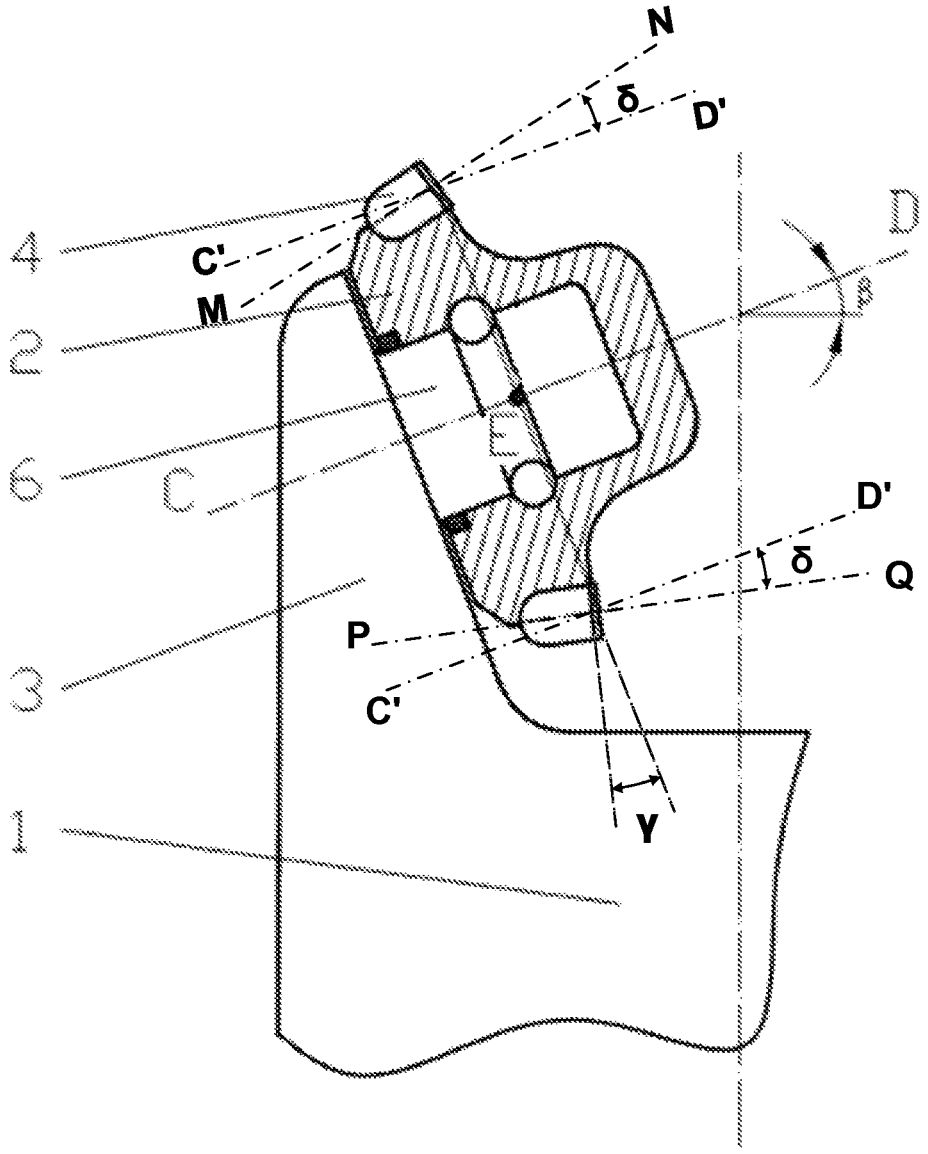
FIG. 28 highlights features disclosed in FIG. 4.

FIG. 28 highlights features disclosed in FIG. 4. The rotational axis CD of the scraping-wheel and the axis along a longitudinal direction of the polycrystalline diamond compact cutter, e.g., PQ or MN, are at an angle. In particular, C'D' is a line parallel to the rotation axis CD that intersects with PQ or MN at the cutting surface of the polycrystalline diamond compact cutter. The angle $\delta$ is in the direction pointing outwardly from the cutting surface and is an acute angle. Also as shown in FIG. 28, the angle $\gamma$ is between the planar cutting surface and the datum plane $A_4$ of the scraping wheel. The angle $\gamma$ is an acute angle.

Figure 22:
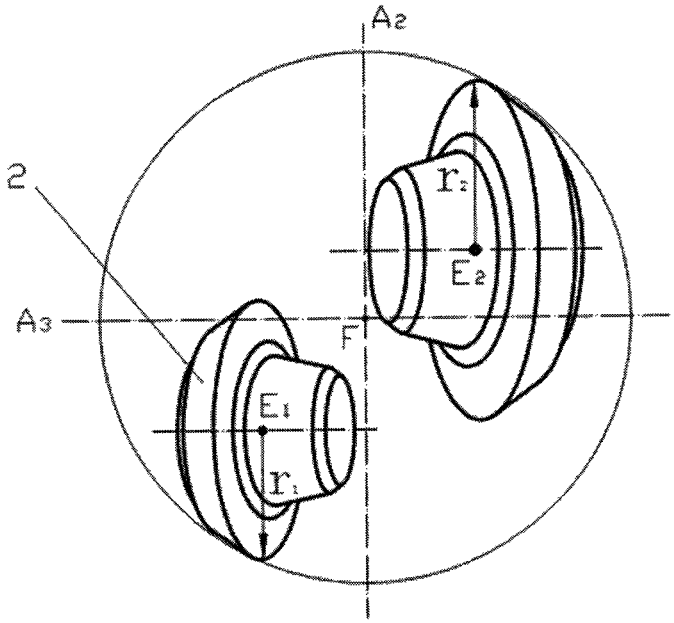
FIG. 22 is a schematic illustration of the scraping-wheels with different diameters; wherein, $r_1 \neq r_2$.

There are at least two scraping-wheel cutting units, the external diameter of at least one of which is different from that of the other ones. As illustrated in FIG. 22, the external diameters of two scraping-wheels are different, i.e. $r_1 \neq r_2$. For the condition with three scraping-wheels, the external diameter of one of which is $r_1$, while the other two are both $r_2$, with $r_1 \neq r_2$; or further, one of the other two is $r_2$, then the rest one is $r_3$, with $r_2 \neq r_3$.

Figure 23:
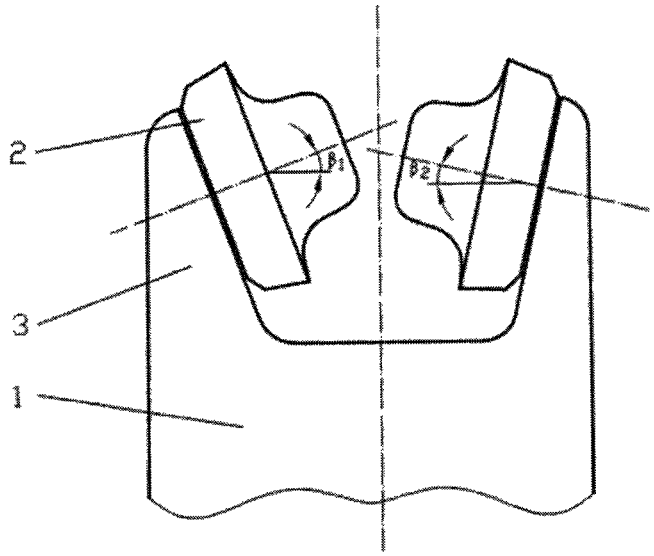
FIG. 23 is a schematic illustration of the scraping-wheels with different journal angles, diameters; wherein, $\beta_1 \neq \beta_2$.

There are at least two scraping-wheel cutting units, the journal angle of at least one of which is different from that of the other ones. As illustrated in FIG. 23, the journal angle of two scraping-wheels are different, i.e. $\beta_1 \neq \beta_2$. For the condition with three scraping-wheels, the journal angle of one of which is $\beta_1$, while the other two are both $\beta_2$, with $\beta_1 \neq \beta_2$; or further, one of the other two is $\beta_2$, then the rest one is $\beta_3$, with $\beta_2 \neq \beta_3$.

There are at least two scraping-wheel cutting units, the cutter-spacing of at least one of which is different from that of the other ones.

Figure 24:
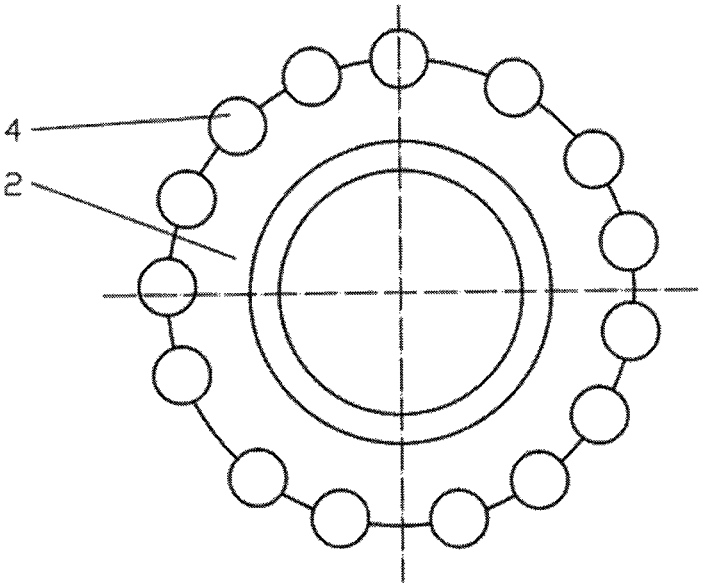
FIG. 24 is a schematic illustration of the scraping-wheels with different cutter-spacing.

The cutter-spacing of the same scraping-wheel is non-uniform. As illustrated in FIG. 24, the cutter-spacing of the scraping-wheel is not uniform.

The cutter-spacing of the inner-row is different from that of the outer-row.

The invention has been shown or described in only some of its forms, it should be apparent to those skilled in the art that it is not so limited, but is susceptible to various changes without departing from the scope of the invention as hereinafter claimed, and legal equivalents thereof.

The invention claimed is:

1. A composite drill bit, comprising:

a bit body with at least one bit leg, at least one fixed blade having a plurality of cutters disposed thereon; and at least one scraping-wheel rotatably mounted on the bit leg, wherein the scraping-wheel comprises an outer-row of cutters disposed along a periphery of the scraping-wheel, wherein the outer-row of cutters comprises one or more polycrystalline diamond compact cutters, wherein an angle $\delta$ is between a rotational axis of the scraping-wheel and an axis along a longitudinal direction of the polycrystalline diamond compact cutter in a direction pointing outwardly from the cutting surface of the polycrystalline diamond compact cutter, wherein the angle $\delta$ is an acute angle, wherein an angular deflection $\alpha$ of the scraping wheel is in a range of $20° \leq |\alpha| \leq 90°$.

2. The composite drill bit of claim 1, wherein the scraping-wheel comprises at least one inner-row of cutters.

3. The composite drill bit of claim 2, wherein the cutters on the fixed blade and on the inner-row are chosen from polycrystalline diamond compact, thermally stable polycrystalline diamond cutters, natural diamond cutters, diamond-impregnated cutters, carbide cutters, cubic boron nitride cutters, ceramic cutters, cutters containing diamond or cubic boron nitride, and combinations thereof.

4. The composite drill bit of claim 2, wherein the cutter-spacing of an outer-row is different from that of an inner-row on the same scraping-wheel.

5. The composite drill bit of claim 1, wherein the outer-row of cutters further comprises cutters chosen from thermally stable polycrystalline diamond cutters, natural diamond cutters, diamond-impregnated cutters, carbide cutters, cubic boron nitride cutters, ceramic cutters, cutters containing diamond or cubic boron nitride, and combinations thereof.

6. The composite drill bit of claim 1, wherein the cutting surface of the polycrystalline diamond compact cutter is planar in shape, and the planar cutting surface and a datum plane of the scraping-wheel are at an acute angle $\gamma$.

7. The composite drill bit of claim 1, wherein the scraping-wheel has only one row of cutters disposed thereon.

8. The composite drill bit of claim 1, comprising two scraping-wheels and two fixed blades arranged in a way so that each scraping wheel is adjacent to two fixed blades.

9. The composite drill bit of claim 1, comprising three scraping-wheels and three fixed blades arranged in a way so that each scraping wheel is adjacent to two fixed blades.

10. The composite drill bit of claim 1, wherein the angular deflection $\alpha$ of the scraping-wheel is in the range of $30° \leq |\alpha| < 90°$.

11. The composite drill bit of claim 10, wherein the angular deflection $\alpha$ of the scraping-wheel is in the range of $40° \leq |\alpha| < 90°$.

12. The composite drill bit of claim 11, wherein the angular deflection $\alpha$ of the scraping-wheel is in the range of $45° \leq |\alpha| < 90°$.

13. The composite drill bit of claim 1, comprising at least two scraping-wheels, wherein the angular deflection of one scraping-wheel is different from that of the other ones.

14. The composite drill bit of claim 1, comprising at least two scraping-wheels, the outer diameter of at least one scraping-wheel is different from that of the other ones.

15. The composite drill bit of claim 1, comprising at least two scraping-wheels, a journal angle of a scraping-wheel of at least one scraping-wheel is different from that of the other ones.

16. The composite drill bit of claim 1, comprising at least two scraping-wheels, a cutter-spacing of at least one scraping-wheel is different from that of the other ones.

17. The composite drill bit of claim 1, wherein cutters on the same scraping-wheel are spaced non-uniformly.

18. The composite drill bit of claim 1, wherein the angular deflection $\alpha$ of the scraping-wheel is in a range of $-90° \leq \alpha \leq -20°$.

19. A composite drill bit, comprising:

at least two scraping-wheels, each rotatably mounted on a respective bit leg; and at least one fixed blade, wherein each scraping-wheel comprises one or more polycrystalline diamond cutters disposed thereon, wherein a first angular deflection $\alpha$ of at least one scraping-wheel is in the range of $20° \leq \alpha \leq 90°$ and a second angular deflection $\alpha$ of at least one other scraping-wheel is in the range of $-90° \leq \alpha \leq -20°$.

* * * * *